US005086913A

United States Patent [19]

Camm et al.

[11] Patent Number: 5,086,913

[45] Date of Patent: Feb. 11, 1992

[54] CONTACT LENS CASE

[75] Inventors: Thomas Camm, 966 Ponus Ridge Rd., New Canaan, Conn. 06840; Louise Wollman, White Plains, N.Y.

[73] Assignee: Thomas Camm, New Canaan, Conn.

[21] Appl. No.: 670,078

[22] Filed: Mar. 15, 1991

Related U.S. Application Data

[63] Continuation-in-part of Ser. No. 478,207, Feb. 9, 1990, abandoned.

[51] Int. Cl.[5] ..... A45C 11/04

[52] U.S. Cl. ..... 206/5.1; 206/459; 134/137

[58] Field of Search ..... 206/5.1, 459; 134/901, 134/137; 116/200, 276

[56] References Cited

U.S. PATENT DOCUMENTS

| | | | |
|---|---|---|---|
| 2,932,383 | 4/1960 | Fagan | 206/5.1 |
| 3,100,691 | 8/1963 | Jones | 116/276 |
| 3,168,100 | 2/1965 | Rich | 134/137 |
| 3,385,258 | 5/1968 | Curtin et al. | 116/200 |
| 3,394,717 | 7/1968 | Hollinger | 134/137 |
| 3,536,082 | 10/1970 | Kolbeck . | |
| 3,661,248 | 5/1972 | Isen et al. | 206/5.1 |
| 3,669,280 | 10/1972 | Sturgeon . | |
| 3,741,377 | 6/1973 | Krellen | 206/5.1 |
| 3,856,571 | 12/1974 | Sherman . | |
| 4,064,826 | 12/1977 | Pauli | 116/276 |
| 4,122,942 | 10/1978 | Wolfon | 206/5.1 |
| 4,141,311 | 2/1979 | Taylor, Jr. | 116/276 |
| 4,328,890 | 5/1982 | Thomas et al. . | |
| 4,337,858 | 7/1982 | Thomas et al. | 206/5.1 |
| 4,392,597 | 7/1983 | Shoup . | |
| 4,406,362 | 9/1983 | Thomas et al. | 206/5.1 |
| 4,415,076 | 11/1983 | Campbell . | |
| 4,545,479 | 10/1985 | Figari . | |
| 4,738,355 | 4/1988 | Tobe | 206/5.1 |
| 4,782,946 | 11/1988 | Pollak . | |
| 4,784,258 | 11/1988 | Figari . | |
| 4,823,944 | 4/1989 | Ryder . | |
| 4,858,981 | 8/1989 | Wright et al. | 206/5.1 |
| 4,897,981 | 2/1990 | Beck | 206/5.1 |

FOREIGN PATENT DOCUMENTS

| | | | |
|---|---|---|---|
| 2154211 | 9/1985 | United Kingdom | 206/5.1 |

*Primary Examiner*—David T. Fidei
*Attorney, Agent, or Firm*—Morgan & Finnegan

[57] ABSTRACT

There is shown a contact lens storage case incorporating an aid for the visual location of a contact lens stored within fluid in the case wherein there is indicia on or within the case of a color different from the case such that an image of the indicial indicates the location of the contact lens. The lens case may also prevent damage to lenses stored within by providing a lens storage compartment positioned separate from the point of contact of a sealing mechanism.

13 Claims, 1 Drawing Sheet

CONTACT LENS CASE

This application is a continuation-in-part of U.S. application Ser. No. 478,207 filed on Feb. 9, 1990 now abandoned.

BACKGROUND AND OBJECTS OF THE INVENTION

1. Field of the Invention

This invention relates to contact lens storage, and more particularly to a portable lens storage device which aids in the location of lenses stored therein, and prevents the tearing or damaging of those lenses.

2. Background Art

Many types of contact lenses must be periodically stored. Some storage cases allow the lenses to be placed in solution until they arr ready for application to the eye.

In the use of such cases, several important factors come into play.

First, contact lenses are typically small and of clear plastic material, making them difficult to see under the best of circumstances. Secondly, these lenses are frequently worn by individuals with impaired vision who can be expected to have difficulty in locating the encased lenses.

Additionally, the lenses are submerged in a fluid which further camouflages their location. These burdens can render an individual with impaired vision practically helpless in spotting the stored lenses.

Additionally, the lenses may be vulnerable to damage from the structure of the case. Many storage cases utilize a container with a screw-on cap. Since many "soft" contact lenses have a flexible composition, they are susceptible to damage if pinched between the cap and the case during closure.

Meniscus forces may contribute to this problem by causing a buoyant lens to adhere to the top of the side wall of the storage compartment. In screw-on capped containers, the top of the side wall is adjacent to the cap engagement area. Thus, the lenses are susceptible to being caught. If caught, the lenses may be torn, deformed or scored when the cap is being screwed into place.

OBJECTS OF THE INVENTION

It is therefore one object of the present invention to provide a contact lens storage case which facilitates access to stored contact lenses.

It is further object of the present invention to provide a contact lens case which allows easy lens storage and location while being simple and inexpensive to manufacture.

It is yet a further object of the present invention to provide a lens case which aids visually handicapped individuals in the location of contact lenses.

It is a still further object of the present invention to provide a lens case which reduces the likelihood of lens damage.

Further objects of the present invention will become apparent from the specification which follows.

SUMMARY OF THE INVENTION

The invention may generally be described as a contact lens storage case incorporating an aid for the visual location of a contact lens stored within fluid in the case. This aid takes the form of an image forming means, on or within the case, arranged to provide an image which is intercepted by the stored lens and thereby refracted or otherwise distorted by the lens to visually indicate the lens location.

The contact lens storage case of the present comprises at least one housing member which may have various geometrical shapes, preferably, cylindrical. This housing member has an open top, side walls and a closed bottom, can have any described color and may be clear or translucent. A cover is associated with each housing member to provide protection from fluid or lens loss from the storage case. When more than one housing member is utilized, the housing members are connected or joined by an integral bridge section.

Indicia is provided as an image forming means on either the case bottom or side walls or both of any described form and which is of a color contrasting to the color of the bottom and/or side walls of the housing. Any desired color can be employed as long as the color used is contrasting to the color of the bottom and/or side walls of the case. The indicia is visually distinguishable from the case bottom and/or side walls which are of a different color. In this way, the indicia provides an image which is intercepted by a lens stored in the housing hence providing an aid for visually locating a contact lens stored within fluid in the case.

As noted above, the color of the bottom and/or side wall and the indicia second color can be any desired colors as long as the indicia color is a contrasting color from that of the bottom and/or side walls. While the bottom can have a first color and the side walls a second color, the bottom and side wall colors may be the same.

With respect to the indicia on the case bottom and/or side walls or both, any desired indicia can be used, including, for example, a grid pattern, a fanciful depiction, a logo, etc. The indicia can be placed on the case bottom and/or side walls or both by any known procedure, for example, molding, printing, application as a decal, engraving, painting, embossing, etc.

In an illustrated embodiment, a contact lens case can have a generally transparent top with a bottom having indicia. The indicia's image becomes distorted where it is intercepted by the lens. This facilitates location of the lens in the case, even for the visually impaired.

In a further embodiment, the lens case has a lens holding cup which separates the lens and the side wall of a fluid storage compartment from the securing structure. A wide lip between the outer periphery of the lens fluid storage compartment and the cap engagement area ensures that the lens is not caught when the lid is screwed on. A curved edge joins the lip and the side wall of the storage compartment. The curved edge maintains the lens away from the cap securing area.

DETAILED DESCRIPTION OF THE PREFERRED EMBODIMENT

Figure 1:
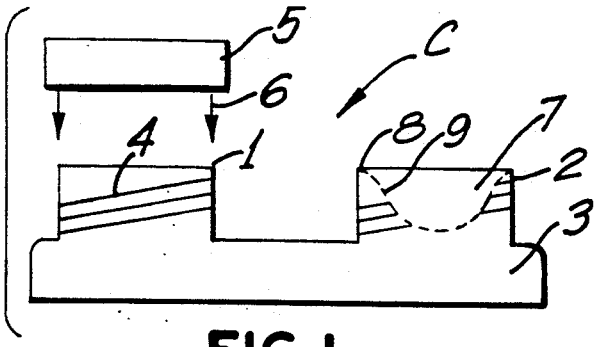
FIG. 1 is a side view of a contact lens case designed according to the present invention.

As seen in the figures, the transparent contact lens case C of the preferred embodiment has two cylindrical sections 1, 2 joined by an integral brdige section 3 to form a single unitary case. The outer circumference of each cylindrical section 1, 2 is threaded as indicated at 4 to mate with a threaded cap 5 as indicated by arrows 6, for accessing and storing the respective lens.

Molded or otherwise installed inside each cylindrical section 1, 2 is a respective lens storage compartment 7 for holding the fluid and the contact lens to be stored therein. The storage compartment has a curved edge 9.

When the lid 5 is removed from the case C, the lens storage compartment 7 is accessible for receiving the fluid and lens. The lid 5 may then be screwed onto threads 4, rendering the lens storage compartment fluid tight and protected from contaminants.

Figure 2:
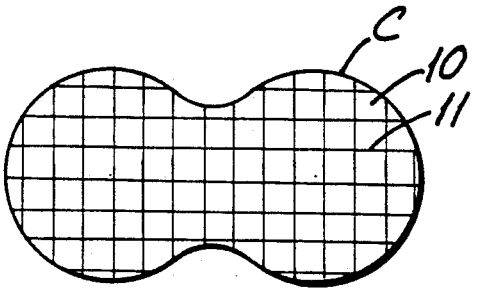
FIG. 2 is a bottom view of the contact lens case illustrated in FIG. 1.

FIG. 2 illustrates an image forming means indicia 11 on the bottom 10 of the case C which is of a color contrasting from the bottom 10. The image forming means indicia 11 forms an image, which in the illustrated embodiment is a grid. This grid image is visually distinguishable from the case. The image forming means indicia may be a pattern molded into the case bottom or engraved or embossed thereon. Alternatively, the pattern or indicia may be printed on the bottom or applied thereto as a decal.

Figure 3:
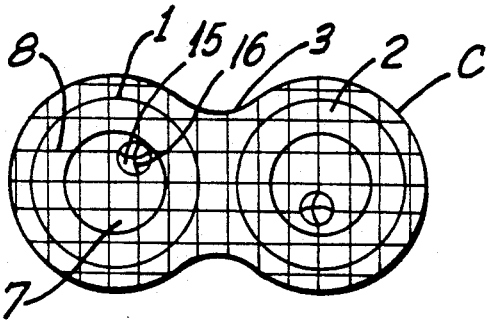
FIG. 3 is a plan view of the contact lens case illustrated in FIG. 1.

FIG. 3 which is a top view of the lens case C illustrates the image of image forming means indicia 11 projected through the transparent case structure, and visually distorted by each lens 15 which is in the image path. This distortion, as shown for example by reference number 16, facilitates visual location of the lens 15.

Figure 4:
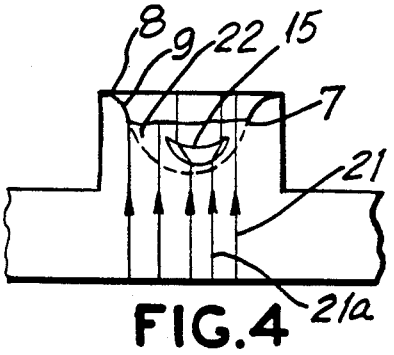
FIG. 4 is an illustration of the distortion of indicia by a contact lens stored in the case according to the present invention.

FIG. 4 illustrates the selective refraction of light rays 21*a* by the contact lens 15 stored in solution 22 in a lens storage compartment 7. In the preferred embodiment, the light is imaged by a decal providing a grid having squares which are 1/32 inch on a side, applied to the bottom of the case.

For grid images, finer patterns appear to enhance the lens induced distortion. To further enhance that lens delineation, the present invention also contemplates the incorporation of a magnifying lens into the lens case lid 5. Thus, when a lens lid 5 is held over the lens storage compartment 7, the distortion is magnified and the lens 15 is even easier to locate.

Figure 3A:
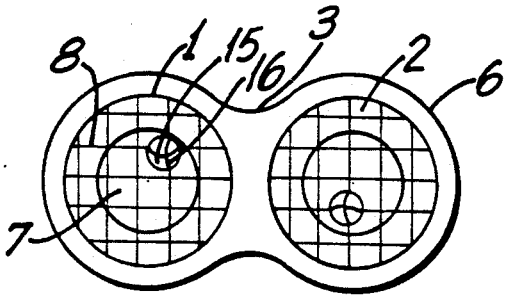
FIG. 3*a* is a plan view of the contact lens case illustrated in FIG. 1 in which the indicia is on the bottom of the storage compartment.

In a further embodiment as illustrate by FIG. 3*a* , an image forming means indicia may also be incorporated into the bottom of the lens storage compartment. In this case, the lens is still locatable by a viewer from the image distortion, and the case does not need to be transparent.

A further feature of the present invention reduces the likelihood of damage to the lenses 15 caused by the closure action. To this end, the wall delineating the lens holding compartment has an extra wide lip 8. The lip 8 has a curved inner edge 9. This lip 8, and/or the curvature of the edge 9, ensure separation of a lens 15, and its being caught when the lid 5 is screwed onto the case.

Figure 5:
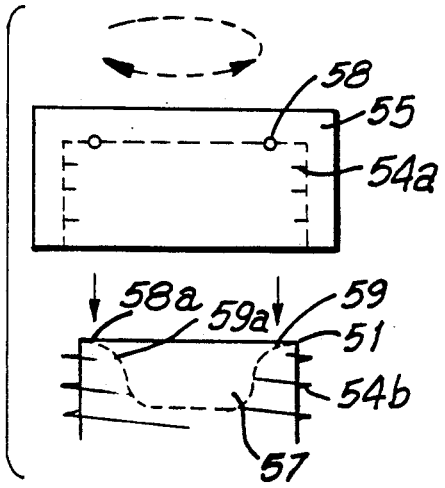
FIG. 5 is an illustration of a lens case structure configured to prevent a lens from being caught in the sealing mechanism.

Further details of the lip structure are illustrated by FIG. 5. As shown, lid 55 has a thread engaging section 54*a* which mates with threads 54*b* on the outer circumference cylindrical section 51. Lid 55 also includes a seal such as an O-ring 58 which sealably engages with the outer periphery of lip 59 to seal the compartment. The inner edge 59*a* of lip 59 is curved to aid in the separation of the lens from the place of contact between the O-ring 58 and the lip 59.

In the preferred embodiment, the lip width is approximately ¼ inch and the O-ring thickness is about ⅛ inch. The O-ring makes contact along the outside half of the lip, leaving the inside half of the lip as space between the lens compartment perimeter and the O-ring contact. A portion of this inside half of the lip is curved to aid in the separation of the lens from the point of O-ring contact.

A number of known lens case designs did not allow for any space between the place of O-ring contact and the outer perimeter of the lens compartment. Any lens adhering to the periphery of the lens compartment was susceptible to being caught in the case sealing mechanism. By allowing for this extra free space, and the curvature of the inside edge of the lip, the present invention reduces the likelihood of damage.

Many variations of the preferred embodiment, falling within the scope of the appended claims, will undoubtedly occur to those skilled in the art.

We claim:

1. A contact lens storage case incorporating an aid for the visual location of a contact lens stored within fluid in the case, comprising:

at least one housing member of a first color, said housing member having an open top, side walls and a closed bottom defining a storage chamber;

a cover member associated with said housing member and adapted to cover said open top, and indicia on said housing member, said indicia of a second color contrasting and different from said housing member and being distinguishable from the housing member to provide an image which can be intercepted by a lens stored in the housing and thereby refracted or otherwise distorted by the lens to visually indicate the lens location within said housing wherein said indicia is viewable through said open top of said housing member.

2. The contact lens case of claim 1, wherein the case is transparent and the indicia is located on a bottom surface of the housing member.

3. The contact lens case of claim 1, wherein the indicia includes location on a side wall of the storage chamber.

4. The contact lens case of claim 1, wherein the indicia is molded within the bottom of the case by embedding.

5. The contact lens case of claim 1, wherein the indicia is a grouping of parallel lines.

6. The contact lens case of claim 1, where the indicia is a pattern of a grid.

7. The contact lens case of claim 1, wherein the cover member further includes a magnifying lens with said cover member being securable to the case to allow the sealing of a storage area.

8. The contact lens case of claim 1, wherein the indicia is molded, etched or painted into the bottom or side wall of the lens case.

9. The contact lens case of claim 1, wherein the lens case comprises right and left housing members which are joined by an integral bridge section.

10. The contact lens case of claim 1, wherein the indicia is a decal.

11. The contact lens case of claim 1, wherein said lens storage compartment has a wide lip along a top perimeter of said storage chamber such that when the cover member is secured onto the top of said storage chamber encapsulating the lens storage compartment, the lens stored within the lens storage compartment is positioned away from a point of contact between the cover member and the top of said storage chamber.

12. The contact lens case of claim 11, wherein the wide lip has a curved inner edge.

13. The contact lens case of claim 11, wherein an O-ring attached to said cover member for allowing a seal makes contact with the lip along an outer perimeter of the lip.

* * * * *